US010851992B2

(12) United States Patent
Neumeister et al.

(10) Patent No.: US 10,851,992 B2
(45) Date of Patent: Dec. 1, 2020

(54) BURNER MANAGEMENT SYSTEM

(71) Applicant: Spartan Controls Ltd., Calgary (CA)

(72) Inventors: Larry Neumeister, Calgary (CA); Dave Skoropad, Calgary (CA)

(73) Assignee: SPARTAN CONTROLS LTD., Calgary (CA)

( * ) Notice: Subject to any disclaimer, the term of this patent is extended or adjusted under 35 U.S.C. 154(b) by 217 days.

(21) Appl. No.: 15/995,385

(22) Filed: Jun. 1, 2018

(65) Prior Publication Data

US 2019/0368731 A1 Dec. 5, 2019

(51) Int. Cl.

| | |
|---|---|
| ***F23N 1/00*** | (2006.01) |
| ***F23N 5/08*** | (2006.01) |
| ***F23N 5/24*** | (2006.01) |

(52) U.S. Cl.

CPC ..... *F23N 1/002* (2013.01); *F23N 5/082* (2013.01); *F23N 5/245* (2013.01); *F23N 2227/02* (2020.01); *F23N 2227/10* (2020.01); *F23N 2231/12* (2020.01); *F23N 2237/02* (2020.01); *F23N 2239/04* (2020.01)

(58) Field of Classification Search

CPC ..... F23N 2237/02; F23N 1/002; F23N 5/082; F23N 5/24; F23N 1/00; F23N 2229/00; F23N 2235/18; F23N 5/08; F23N 5/245; F23N 2227/02; F23N 2227/10; F23N 2231/12; F23N 2239/04; F23N 5/242; F23D 23/00; F23K 5/005

See application file for complete search history.

(56) References Cited

U.S. PATENT DOCUMENTS

| | | | | |
|---|---|---|---|---|
| 2,889,872 A * | 6/1959 | Suesserott | F23D 23/00 431/48 |
| 3,684,423 A * | 8/1972 | Bryant | F23N 5/242 431/24 |
| 3,749,546 A * | 7/1973 | Reed | F23G 7/08 431/5 |
| 4,065,248 A * | 12/1977 | Straitz, III | F23G 7/08 431/202 |
| 4,229,157 A * | 10/1980 | Ito | F23G 7/08 431/12 |
| 4,520,390 A * | 5/1985 | Paredes | F23N 5/082 505/445 |

(Continued)

*Primary Examiner* — Jorge A Pereiro

(74) *Attorney, Agent, or Firm* — Thompson Hine LLP

(57) ABSTRACT

The present disclosure provides a burner management system (BMS) for an industrial gas appliance and method for controlling a warm-up operation of the industrial gas appliance. The BMS and control method only requires a subset of the burners to be provided with flame detectors. In accordance with one aspect, the method involves lighting a supervised burner by providing a fuel gas flow thereto; continuously detecting a flame at the supervised burner indicating that the supervised burner is lit; incrementally lighting non-supervised burners by providing the fuel gas flow thereto when a non-supervised burner status indicates a safe lighting condition, the non-supervised burner status being determined by: measuring a total fuel gas flowing to the plurality of burners; and determining the number of the non-supervised burners with the fuel gas flowing thereto from the measurement of the total fuel gas and a supervised burner status.

18 Claims, 7 Drawing Sheets

(56) References Cited

U.S. PATENT DOCUMENTS

| | | | | | |
|---|---|---|---|---|---|
| 4,548,577 | A * | 10/1985 | McGill | F23G 7/08 | 431/12 |
| 4,637,348 | A * | 1/1987 | Fukayama | F22B 35/18 | 122/406.5 |
| 4,699,586 | A * | 10/1987 | Snyder | F23N 1/00 | 431/6 |
| 9,523,503 | B2 * | 12/2016 | Mohr | F02C 9/28 | |
| 2004/0101796 | A1 * | 5/2004 | Hilton | C01B 3/384 | 431/8 |
| 2006/0144049 | A1 * | 7/2006 | Haffner | F23N 1/002 | 60/776 |
| 2010/0126431 | A1 * | 5/2010 | Kanda | F23N 1/022 | 122/14.21 |
| 2011/0113993 | A1 * | 5/2011 | Esmaili | B01J 19/0006 | 110/186 |

* cited by examiner

BURNER MANAGEMENT SYSTEM

TECHNICAL FIELD

The present disclosure relates to a burner management system, as well as a method for controlling a warm-up operation of an industrial gas appliance.

BACKGROUND

A burner management system (BMS) is typically used as a specific control system dedicated to the safety control of a fired appliance. Several well accepted design codes and guidelines exist for BMSs, set by standards bodies such as the Canadian Standards Association (CSA) and National Fire Protection Association (NFPA). The traditional application of these codes requires a flame detector to be installed on each burner in the industrial gas appliance, which can verify the presence of a flame in the burner to indicate that the burner has been properly lit. The code guidelines generally require that every burner is supervised using a flame detector with a response time not to exceed four seconds. However, with multi-burner applications, there becomes a saturation level in designing the system with an overwhelming amount of instrumentation.

The requirement of providing a flame detector at each burner creates several challenges for plant operators and stakeholders, particularly as the number of burners increases (some plants may have more than one hundred burners). Such challenges include capital cost requirements and a high level of ongoing maintenance. As such, the industry is reluctant to implement burner management systems with flame detectors installed at every burner.

Accordingly, improved, additional, and/or alternative burner management systems and control methods remain highly desirable.

SUMMARY

The present disclosure describes a method of controlling a warm-up operation of an industrial gas appliance, the method comprising: lighting a supervised burner among a plurality of burners in the industrial gas appliance by providing a fuel gas flow thereto; continuously detecting a flame at the supervised burner indicating that the supervised burner is lit; incrementally lighting non-supervised burners among the plurality of burners by providing the fuel gas flow thereto when a non-supervised burner status indicates a safe lighting condition, the safe lighting condition occurring when a number of non-supervised burners with the fuel gas flowing thereto is less than a predetermined threshold number of burners, the non-supervised burner status being determined by: measuring a total fuel gas flowing to the plurality of burners; and determining the number of the non-supervised burners with the fuel gas flowing thereto from the measurement of the total fuel gas flowing to the plurality of burners and a supervised burner status indicating the detection of the flame at the supervised burner.

The present disclosure also describes a burner management system for an industrial gas appliance comprising a plurality of gas burners, the system comprising: one or more flame detectors each configured to perform flame detection of respective supervised burners among the plurality of burners, the plurality of burners comprising a first group of burners having at least one supervised burner and at least one non-supervised burner; a gas flow meter for measuring a cumulative fuel gas flow to the first group of burners; and a controller configured to: continuously receive an indication from the one or more flame detectors whether a flame for each of the at least one supervised burner is detected; receive the measured cumulative fuel gas flow from the gas flow meter; and determine a non-supervised burner status for the first group of burners based on the number of non-supervised burners with fuel gas flowing thereto, wherein the number of non-supervised burners with fuel gas flowing thereto is determined from the measurement of the cumulative fuel gas flowing to the first group of burners and a supervised burner status indicating the detection of the flame at the respective supervised burners, and wherein when the non-supervised burner status indicates an unsafe lighting condition the controller restricts the opening of a burner firing valve associated with any unlit non-supervised burner in the first group of burners, the unsafe lighting condition occurring when the number of non-supervised burners is equal to a predetermined threshold number of burners.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
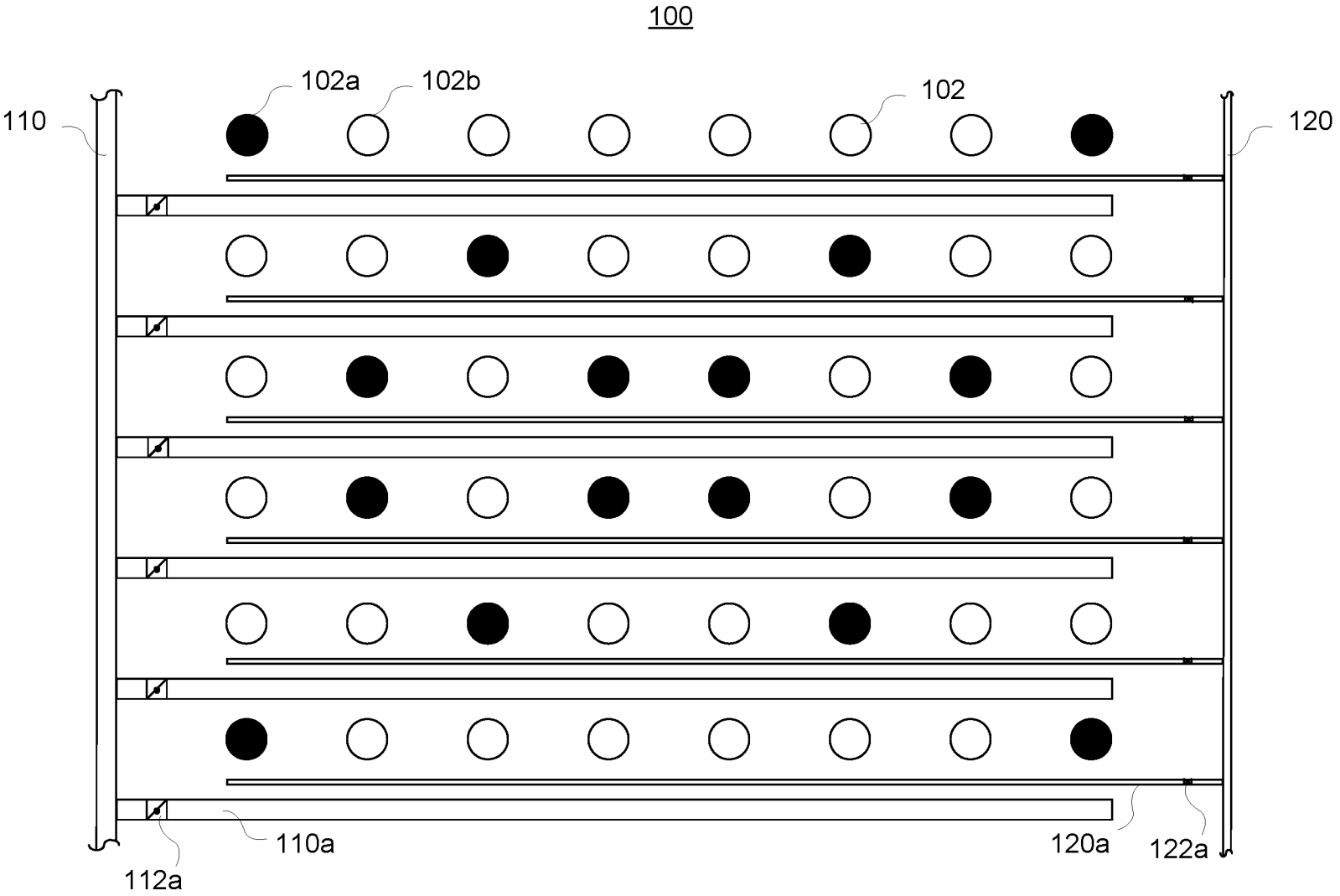
FIG. 1 shows a simplified representation of an industrial gas appliance comprising a plurality of burners.

The present disclosure provides a burner management system (BMS) for an industrial gas appliance and method for controlling a warm-up operation of the industrial gas appliance. Industrial gas appliances as referred to herein may relate to any type of furnace, reformer, etc. that comprises gas-fired burners as combustion devices for producing heat. The BMS and control method may be implemented in the design and construction of both new industrial gas appliances as well as retrofitting existing industrial gas appliances.

For an industrial gas appliance comprising a plurality of burners, the BMS as described herein only requires a subset of the burners to be provided with flame detectors. Accordingly, the BMS helps to reduce capital cost and maintenance requirements, among other challenges, that are associated with installing a flame detector at each burner. Burners that are provided with flame detectors are referred to herein as 'supervised burners', and burners that are not provided with flame detectors are referred to herein as 'non-supervised burners'.

The BMS comprises a gas flow meter for measuring a total/cumulative fuel gas flow to the plurality of burners and/or to a group of burners. A controller, also referred to herein as a BMS controller, is communicatively coupled with the flame detector(s) and gas flow meter(s), and is configured to execute control of the burner operation, which includes monitoring and restricting control of burner firing valves during light-off, as well as outputting commands for tripping safety shut off valves if the system becomes unsafe to operate.

One of the most dangerous conditions of operating an industrial gas appliance is during warm-up when burners are being initially lit. Many fire safety codes, including those set by CSA and NFPA, have a provision to allow for auto-ignition. Once a temperature of the industrial gas appliance has reached the auto-ignition temperature for the fuel gas being used in combustion, the presence of excess fuel gas or a high concentration of fuel gas in the system has reduced impact on the safety of operating the industrial gas appliance because the fuel gas will spontaneously ignite without an external source of ignition. However, prior to the industrial gas appliance temperature reaching the auto-ignition temperature for the fuel gas, the presence of excess fuel gas or a high concentration of fuel gas poses a more serious safety risk. Particularly, a concentration of un-combusted fuel gas within the system that reaches the lower explosive limit of the gas may result in an ignition/explosion of the fuel gas in the presence of an ignition source.

The BMS and method of controlling a warm-up operation of the industrial gas appliance as described herein ensures safe operation of the industrial gas appliance using lower explosive limit based control. By determining a maximum amount of un-combusted fuel gas that might be present in the system, and controlling the operation of burners to maintain the maximum amount of possibly un-combusted fuel gas below an amount that corresponds to a concentration of fuel gas equal to the lower explosive limit of the fuel gas, the industrial gas appliance may be safely operated without requiring a flame detector to be installed at each burner.

During the warm-up operation of the industrial gas appliance, an operator lights individual burners by opening a burner firing valve that permits the fuel gas to flow to the burner and react with combustion gas. When a burner is firing and operating within prescribed boundary limits, the fuel gas is combusted and does not contribute to the amount of un-combusted fuel gas in the system. However, to reduce capital cost and maintenance requirements, in accordance with the present disclosure only some of the burners in the industrial gas appliance have flame detectors installed thereon. Therefore a verification that the fuel gas being provided to a respective burner is combusted can only be made at supervised burners for which the flame detector can detect the presence of a flame in the burner. For the remaining non-supervised burners that are not fitted with a flame detector, there is no way to verify that a respective burner is operational and that the fuel gas flowing thereto is being combusted. When a non-supervised burner is lit by the operator the fuel gas flowing thereto contributes to the amount of possibly un-combusted fuel gas in the system.

A determination of the maximum amount of un-combusted fuel gas that might be present in the system is made, which is proportional to the number of non-supervised burners that have been lit. The total fuel gas flow that is provided to the plurality of burners, or to a group of burners, comprising both supervised burners and non-supervised burners, may be measured. The flame detectors at supervised burners can indicate that the respective supervised burner is lit when a flame is detected. Accordingly, the amount of fuel gas that is provided to supervised burners that are confirmed to be operational can be subtracted from the measured total fuel gas flow. The result is a maximum amount of un-combusted fuel gas that might be present in the system. The maximum amount of un-combusted fuel gas that might be present in the system assumes the worst-case scenario of none of the non-supervised burners being lit properly, and thus none of the fuel gas flowing thereto is combusted. This worst-case scenario provides for maximum safety when operating the industrial gas appliance during start-up. However, various factors could be used that affect the determination of the maximum amount of un-combusted fuel gas that might be present in the system. For example, it might be assumed that at worst, only 50% of the non-supervised burners may fail to operate correctly.

Based on the maximum amount of un-combusted fuel gas that might be present in the system, a number of non-supervised burners that have been lit (among the plurality of burners, or within a group of burners) can be determined. It may be predetermined prior to performing the warm-up operation and burner light-off that a certain number of nonoperational burners with un-combusted fuel gas flowing thereto would result in the accumulation of fuel gas to a concentration that is just below the lower explosive limit of the fuel gas. Accordingly, the determined number of non-supervised burners that have been lit can be compared to the predetermined number, and the BMS may restrict lighting of additional non-supervised burners once the number of lit non-supervised burners reaches the predetermined number. A non-supervised burner status may be used to indicate a safe lighting condition or an unsafe lighting condition for incrementally lighting additional non-supervised burners based on a comparison of the number of non-supervised burners with the fuel gas flowing thereto to a predetermined threshold number of burners. Moreover, if the amount of possibly un-combusted fuel gas in the system approaches or exceeds a concentration corresponding to the lower explosive limit of the fuel gas, the system may be tripped to prevent further flow of the fuel gas into the system.

The above-described features of the BMS and method of controlling the warm-up operation of the industrial gas appliance are further described below, by way of example only, with reference to FIGS. 1-5.

FIG. 1 shows a simplified representation of an industrial gas appliance 100 comprising a plurality of burners 102. The representation of the industrial gas appliance shown in FIG. 1 is depicted in plan view.

The industrial gas appliance 100 comprises a plurality of burners 102. In this exemplified industrial gas appliance system, there are 48 burners, however it will be readily appreciated that the industrial gas appliance 100 may comprise more or less than 48 burners. Advantageous effects described in this disclosure become more apparent as the number of burners within the industrial gas appliance increases.

Each burner 102 among the plurality of burners is designed to receive fuel gas and combustion gas as reactants, which are in turn combusted to produce heat. The heat generated from the burners in the industrial gas appliance can be used in a variety of industrial applications. One such industrial application, which is provided for the sake of example only, is in fertilizer production or ammonia plants.

The combustion gas and fuel gas may be provided within the industrial gas appliance 100 via a combustion gas header 110 and a fuel gas header 120, respectively. Each of the combustion gas header 110 and fuel gas header 120 may have several branches that respectively provide the combustion gas and fuel gas to groups of the burners. As exemplified in FIG. 1, the combustion gas header 110 and fuel gas header 120 may have branches such as combustion gas branch **110*a*** and fuel gas branch 120*a* that respectively provide combustion gas and fuel gas for a row of burners. Although the combustion gas branches and fuel gas branches are shown as being associated with a row of burners, it would be well appreciated by a person skilled in the art that other configurations for delivering combustion gas and fuel gas to the plurality of burners are possible.

Each combustion gas branch 110*a* may comprise, among other things, a damper actuator 112*a* that regulates the flow of combustion gas in the branch 110*a*. Each fuel gas branch 120*a* may comprise, among other things, a fuel control valve 122*a* that controls the flow of fuel gas in the branch 120*a*. Each burner 102 may be respectively connected to the combustion gas and fuel gas branches. Further piping and instrumentation components that are provided along the combustion gas header/branch and the fuel gas header/branch are described with reference to FIG. 2.

As depicted in FIG. 1, the plurality of burners 102 may comprise some supervised burners 102*a* (represented in FIG. 1 as being shaded), and some non-supervised burners 102*b*. Each supervised burner 102*a* comprises a flame detector (not shown in FIG. 1) installed thereon that is configured to detect the presence of a flame in the supervised burner 102*a*. That is, the flame detector can verify that the supervised burner 102*a* is operating correctly and that fuel gas provided to the burner is combusted. The flame detector may be, for example, an optical flame detector or a flame rod detector. The flame detector should be configured to withstand high ambient temperatures in accordance with temperatures reached in the industrial gas appliance.

As shown in FIG. 1, only a subset of the plurality of burners 102 are supervised burners 102*a* having a flame detector installed thereon. The supervised burners 102*a* may be distributed among the plurality of burners 102 in a predefined arrangement. For example, and as may particularly be the case in an industrial gas appliance having a large number of burners, the plurality of burners 102 may be segregated into different groups. In the representation of the industrial gas appliance 100 depicted in FIG. 1, groups of burners may correspond to respective rows. However, such a grouping of burners is made for the sake of explanation only and other groupings of burners are possible. The supervised burners 102*a* may be distributed among the plurality of burners 102 so that each group of burners has at least one supervised burner 102*a*. For example, in FIG. 1 some groups (i.e. rows) of burners have two supervised burners 102*a* and six non-supervised burners 102*b*, and some groups of burners have four supervised burners 102*a* and four non-supervised burners 102*b*.

The number of supervised burners 102*a* among the plurality of burners 102 and the segregation of groups of burners may vary and may be dependent upon standard operating procedures of the plant. As an example, it is often desirable when lighting burners from a cold start to provide even heating of the industrial gas appliance. The supervised burners 102*a* may be lit first, since the installation of the flame detectors at the supervised burners 102*a* allow for successful lighting of these burners to be easily verified.

Accordingly, as exemplified in FIG. 1, the four burners at each corner of the industrial gas appliance 100 may be a supervised burner 102*a*, and during a warm-up operation of the industrial gas appliance the burners may be lit in a criss-cross fashion such that the burner in the top-left corner may be lit first, then the burner in the bottom-right corner may be lit second, then the burner in the top-right corner may be lit third, and the burner in the bottom-left corner may be lit fourth. Each of the burners may be lit by opening a burner firing valve that provides fuel gas to the burner, and the flame detector at the respective burner can detect a presence of a flame to verify that the burner is operating and the fuel gas is combusting. If a flame is not detected, the burner firing valve may be closed to shut off fuel gas to the burner.

The start-up procedure, which may vary and is only described for the sake of example, may continue by lighting supervised burners 102*a* at the interior of the industrial gas appliance 100. Subsequently, supervised burners 102*a* disposed between the interior and exterior of the industrial gas appliance may be lit. After the supervised burners 102*a* have been lit, non-supervised burners 102*b* may be lit in a similar order to ensure an even heating pattern of the industrial gas appliance 100 is obtained. The start-up procedure may be used to perform warm-up control of the industrial gas appliance until an auto-ignition temperature of the fuel gas is reached in the industrial gas appliance. Once the auto-ignition temperature has been reached, any remaining unlit burners (including supervised burners 102*a* and non-supervised burners 102*b*) may be lit.

While an example start-up procedure has been provided above to describe one possible configuration for performing a warm-up operation of the industrial gas appliance, a person skilled in the art will readily appreciate that start-up procedures may vary and may be dependent on the configuration of the plant and/or dependent on plant operators. Furthermore, although the above example start-up procedure has described that all of the supervised burners 102*a* are lit first and then all of the non-supervised burners 102*b* are lit, such a restriction on controlling the warm-up operation of the industrial gas appliance is not required. For example, and as will be further described herein, some of the supervised burners 102*a* may be lit and then some of the non-supervised burners 102*b* may be lit without having lit all of the supervised burners 102*a*. In some instances, some non-supervised burners 102*b* may be lit before lighting any of the supervised burners 102*a*.

By installing a flame detector on only a subset of the plurality of burners 102, capital cost and maintenance requirements associated with the flame detectors may be significantly reduced while still allowing for a burner management system to safely control the burner operation of the industrial gas appliance 100.

Figure 2:
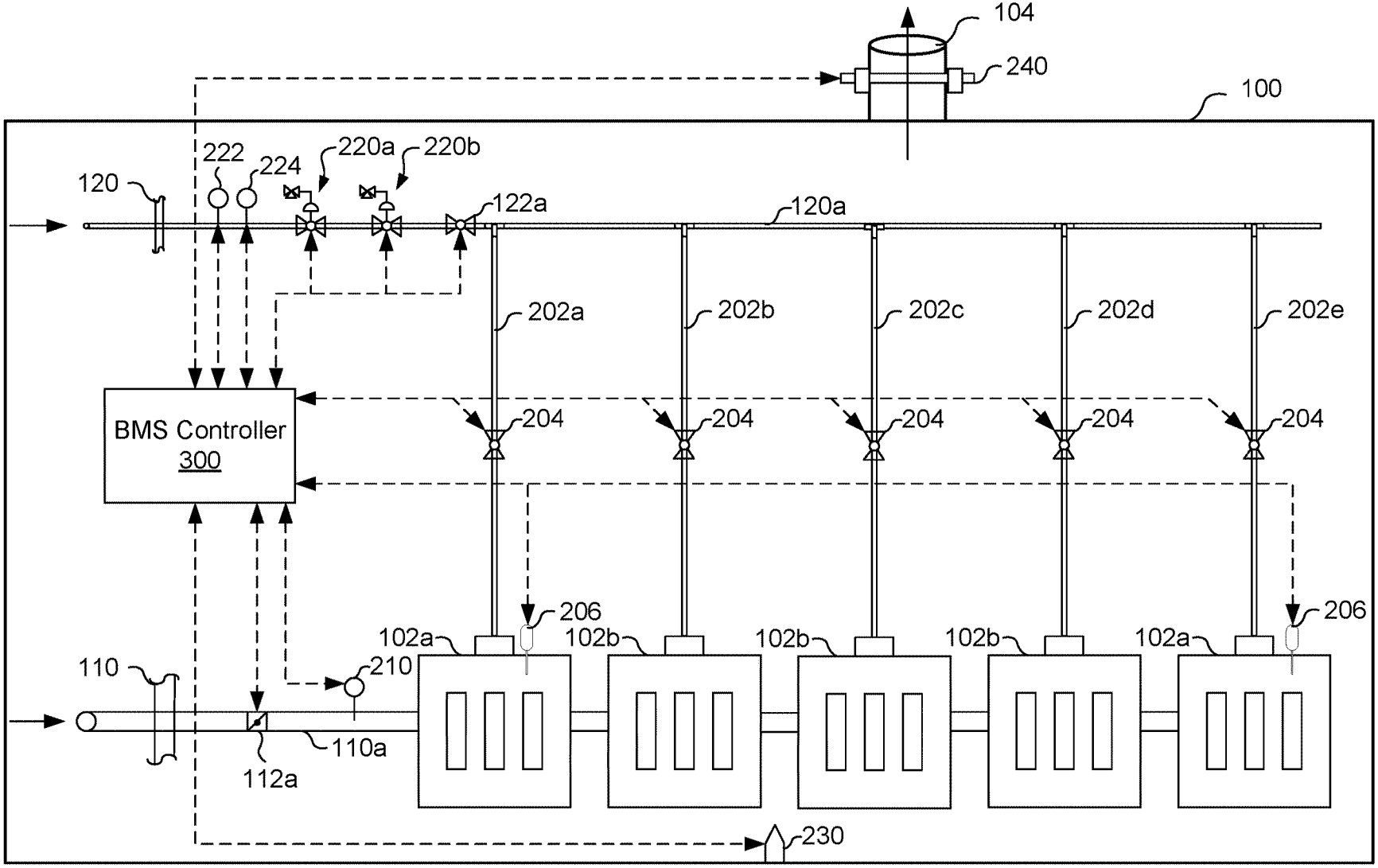
FIG. 2 shows a representation of a burner management system controlling the operation of a group of burners among the plurality of burners.

FIG. 2 shows a representation of a burner management system controlling the operation of a group of burners among the plurality of burners. Particularly, FIG. 2 shows the interaction between a BMS controller 300 and various instrumentation and piping components for a group of burners in the industrial gas appliance 100, where the group of burners may for example correspond to a row of burners such as depicted in FIG. 1, although only five burners are shown in FIG. 2. The BMS controller 300 may be specifically dedicated to control of the burners and may be independent of all other control systems so as to exclusively control only the safety portion of the burner management system.

Each of the burners 102 are respectively connected to the fuel gas branch 120*a* which branches from the fuel gas header 120, and with the combustion gas branch 110*a* which branches from the combustion gas header 110. As previously described, the burners receive combustion gas and fuel gas as reactants, and the reactants combust to produce heat in the industrial gas appliance 100. Lighting of a burner comprises opening appropriate valves to provide combustion gas and fuel gas to the burner. An operator may manually cause combustion of the gases by providing an ignition source, or alternatively the burners may comprise pilot lights/flames.

The combustion gas flows through the combustion gas header 110 and the combustion gas branch 110*a* to the burners 102. For the sake of clarity in the drawing, FIG. 2 does not depict the separate branches that may exist from the combustion gas branch 110*a* to each of the individual burners 102. The separate branches to each of the burners may comprise appropriate instrumentation there-along for controlling the flow of combustion gas to respective burners, such as through the use of air registers (not shown). In this manner, the flow of combustion gas to the respective burners may be adjusted, e.g., through the use of controls and/or manually. The combustion air flow is established and maintained at a minimum adequate flow to support combustion during the start-up sequence and throughout normal operation of the industrial gas appliance. As previously described, a damper actuator 112*a* in the combustion gas branch 110*a* may be used to regulate the flow of combustion gas in the branch 110*a*. The damper actuator 112*a* may, for example, be equipped with a fail last valve, and may be a pneumatic actuator that is coupled with a draft shaft including an E/P positioner (not shown in FIG. 2), however other types of dampers may also be used. The damper actuator 112*a* may be controlled by, and communicatively coupled with, the BMS controller 300.

Various other instrumentation and equipment may be included along the combustion gas branch 110*a*, and these components are collectively shown as element 210 in FIG. 2. For example, an air flow element or other air flow measuring technology may be included in the combustion gas branch 110*a*. The air flow element may, for example, be a mechanical averaging annubar. The combustion gas branch 110*a* may also include an air flow transmitter. The air flow transmitter may, for example, be implemented as dual differential pressure transmitters to ensure minimum differential readings. One of the transmitters may be purposed for the BMS controller 300 and the other for fuel air ratio control and air flow balancing. The air flow transmitter may provide a LO-LO trip signal, as well as indication of a HI flow purge condition. A duct pressure transmitter may also be installed in the combustion gas branch 110*a*, which may be used to verify duct static pressure as a LO-LO interlock and a HI air flow permissive for purging. The elements 210 (e.g., the air flow element, air flow transmitter, duct pressure transmitter, etc.) may each be controlled by, and communicatively coupled with, the BMS controller 300.

Fuel side piping and instrumentation equipment is used to provide proper control of the fuel gas flow and to prevent unsafe operating conditions, such as preventing the accumulation of fuel gas to levels that approach the lower explosive limit of the fuel gas.

As previously described, the fuel gas branch 120*a* may be installed with a fuel control valve 122*a* that is used to control the flow of fuel gas from the fuel gas header 120 into the fuel gas branch 122*a*. Furthermore, each burner has a respective fuel gas inlet piping 202*a-e* that connects the burner to the fuel gas branch 120*a*. Each fuel gas inlet piping 202*a-e* comprises a burner firing valve 204 that controls the flow of fuel gas to the respective burner and which is adjusted to an open position when lighting the burner and a closed position when the burner is not in operation. The flow control valve 122*a* and each of the burner firing valves 204 may be controlled by, and communicatively coupled with, the BMS controller 300 or other form of control. The BMS controller 300 may output commands to control the flow control valve 122*a* and/or the burner firing valves 204. For example, the BMS controller 300 may send electrical signals that cause the opening and closing of these valves. In other embodiments, an operator may manually adjust the burner firing valve 204 to light a burner if not directly controlled by the BMS controller 300. The BMS controller 300 may output commands to open/close the burner firing valves and/or restrict opening of additional burner firing valves, as further described herein. In the case where the burner firing valves are manually controlled, the BMS controller 300 may output the command to an operator of the industrial gas appliance, for example by indicating visually on a display or through lights (e.g. flashing lights), audibly through speakers, etc.

The fuel gas branch 120*a* further comprises a safety shut-off valve (or two safety shut-off valves 220*a* and 220*b* for increased safety) installed there-along. The number of safety shut-off valves may be influenced by the number of burners that the fuel gas branch 120*a* feeds, as required by code. The safety shut-off valves 220*a-b* may be controlled by, and communicatively coupled with, the BMS controller 300. Particularly, if it is determined that there may be a possibility and/or detection of an unsafe concentration of fuel gas for the group of burners, the controller may trip the group of burners and prevent fuel gas from flowing thereto by outputting a command to close the safety shut-off valves 220*a-b*.

A gas flow meter 222 is also installed in the fuel gas branch 120*a*. The gas flow meter 222 may be a high turndown and repeatable flow transmitter that is capable of measuring the fuel gas flow through the fuel gas branch 120*a* to each group of burners. As will be further described herein, the measurement by the gas flow meter 222 is used by the BMS controller 300 for controlling the operation of the industrial gas appliance 100 within safe limits, and accordingly the gas flow meter 222 must be accurate. The gas flow meter 222 may be controlled by, and communicatively coupled with, the BMS controller 300.

Various other instrumentation and equipment may be included along the fuel gas branch 120*a*, and these components are collectively shown as element 224 in FIG. 2. For example, a valve proving transmitter may be provided and disposed between the safety shut-off valves 220*a-b* to avoid a vent line. A gas pressure regulator may also be installed in the fuel gas branch 120*a* to ensure that pressure deviations which may be caused if the group of burners is tripped does not affect adjacent groups of burners and cause an industrial gas appliance gas pressure swing. This may be particularly important as valves supplied in the fuel gas header 120 may be slow to respond or respond with various behaviours as the flow of fuel gas changes. The gas pressure regulator should be sufficiently constructed to manage the fuel gas temperature. The fuel gas branch 120*a* may further comprise a pressure transmitter installed there-along to monitor LO and HI gas pressure conditions leading to an unstable burner operating outside of the designed pressure window. A bypass regulator may also be installed in the fuel gas branch 120*a* to ensure constant lightoff pressure as burners are lit, and to avoid nuisance pressure swings and LO or HI local pressure trips otherwise caused by the pressure transmitter disposed along the fuel gas branch 120*a*. The bypass regulator, along with the other components, should be constructed using a high-temperature design. The elements 220 (e.g., the valve proving transmitter, gas pressure regulator, pressure transmitter, bypass regulator, etc.) may each be controlled by, and communicatively coupled with, the BMS controller 300.

The group of burners shown in FIG. 2 comprises two supervised burners 102*a* and three non-supervised burners 102*b*. Each supervised burner 102*a* has a flame detector 206 installed thereon. The flame detector 206 may, for example, be located on an inspection port of the burner. The location of the flame detector 206 should not interfere with the ability of the operator to light-off the burner. The flame detector 206 may be easily removable using unions and quick disconnects for the electrical power/signal. The flame detector 206 may be controlled by, and communicatively coupled with, the BMS controller 300, and provide measurements with respect to the flame detection to the BMS controller 300. The measurement by the flame detector 206 provides a supervised burner status and is used by the BMS controller 300 for proving the presence of a flame, and ultimately allowing fuel gas to be issued to the fuel gas branch 120*a*. Specifically, the respective supervised burner 102*a* having the flame detector 206 installed thereon can be used to confirm that the supervised burner 102*a* is combusting the fuel gas, and therefore that the fuel gas is not concentrating in the industrial gas appliance system.

The BMS controller 300 safely controls operation of the plurality of burners 102 within the industrial gas appliance 100 by ensuring that a concentration of the fuel gas does not approach/exceed the lower explosive limit for the fuel gas. The BMS controller 300 utilizes flame detection measurement received from flame detectors 206 on supervised burners 102*a* to verify that fuel gas which is provided to the supervised burners 102*a* is being combusted appropriately and is therefore not building-up within the system. However, as previously described it is prohibitive to install flame detectors 206 on every burner within the industrial gas appliance 100. Without flame detectors installed on non-supervised burners 102*b*, the BMS controller 300 cannot verify that the fuel gas provided to the non-supervised burners 102*b* is combusted.

Although the BMS controller 300 cannot confirm if fuel gas provided to the non-supervised burners 102*b* is combusted, the controller can safely control operation of the industrial gas appliance using lower explosive limit based BMS control. The BMS controller 300 is configured to receive measurement data from the flame detectors 206 at each of the supervised burners 102*a* as a supervised burner status indicating whether or not a flame is detected at the respective supervised burner 102*a*. The BMS controller 300 is also configured to receive measurement data from the gas flow meter 222 indicating the fuel gas flow through the fuel gas branch 120*a*. The fuel gas flow as detected by the gas flow meter 222 is proportional to the number of burners (both supervised and non-supervised) for which the respective burner firing valve 204 has been opened and fuel gas is flowing thereto. When a flame is detected at a supervised burner 102*a* by the flame detector 206, the BMS controller 300 can subtract any fuel gas flow attributed to the respective supervised burner as it has been verified by the detection of the flame that the fuel gas provided to the supervised burner is being combusted. The fuel gas flow attributed to non-supervised burners, for which combustion of the fuel gas cannot be verified, can therefore be determined. The BMS controller 300 can be configured to control lighting of non-supervised burners 102*b* (i.e. by opening the respective burner firing valve 204) such that even if fuel gas is provided to the non-supervised burners and does not combust, the concentration of the fuel gas in the system does not approach or exceed the lower explosive limit for the fuel gas.

For example, suppose that it is known that if two of the burner firing valves 204 are open in FIG. 2 but the fuel gas is not combusted by the respective burner, then the concentration of the fuel gas in the system would remain just below the lower explosive limit for the fuel gas. If, for example, the BMS controller 300 receives from the gas flow meter 222 that the fuel gas flow rate corresponds to three burner firing valves being opened, then this would be an unsafe operating condition in the event that none of the fuel gas is being combusted. However, suppose that the BMS controller 300 receives an indication from one of the flame detectors 206 that a flame is detected in a supervised burner 102*a*. It is therefore verified that fuel gas flow to that supervised burner is being combusted, and thus it is only possible for the fuel gas provided to at most two burners to be un-combusted, which would be within safe operating levels. If an operator then chose to light a second supervised burner 102*a* and a flame was detected by the flame detector 206 at the respective supervised burner, this would be permitted because the fuel gas provided thereto could be verified as being combusted. However, if an operator wished to open a firing valve 204 to another non-supervised burner 102*b*, such an action would be prevented by the BMS controller 300 because the amount of fuel gas flowing to the burners that could not be accounted for as being combusted would approach or exceed a predetermined threshold amount of fuel gas corresponding to a concentration that is equal a lower explosive limit of the fuel gas. Likewise, if a flame detector 206 were to detect that a flame in a supervised burner 102*a* which was previously lit has now been extinguished, this would result in an unsafe condition because there would be three burner firing valves open for which fuel gas cannot be verified as being combusted. The BMS controller 300 in this case may trip the group of burners by closing one or both of the safety shut-off valves 220*a-b*.

The above control by the BMS controller can be utilized during a warm-up operation of the industrial gas appliance when the temperature of the industrial gas appliance does not exceed the auto-ignition temperature of the fuel gas. Once the temperature of the industrial gas appliance exceeds the auto-ignition temperature of the fuel gas, the possibility of un-combusted fuel gas concentrating in the system is not a concern because the fuel gas will spontaneously ignite at such temperature without any external source of ignition. Further description of a method of controlling the warm-up operation of the industrial gas appliance is provided with reference to FIGS. 4A-4C and FIG. 5.

The BMS controller 300 may be coupled with a thermocouple 230 or other temperature sensor that is installed in the industrial gas appliance 100 for measuring the temperature of the industrial gas appliance 100. The thermocouple 230 may be located outside of the radiant section of the industrial gas appliance 100 to reduce radiant effects of the flame on the temperature measurement and thus represent a conservative value of the industrial gas appliance temperature. Once the industrial gas appliance temperature reaches the auto-ignition temperature of the fuel gas, the aspects of the BMS controller 300 related to the lower explosive limit based control may be bypassed.

As an additional layer of safety protection, an outlet gas analyzer 240 may also be optionally installed on an exhaust stack 104 of the industrial gas appliance 100. The outlet gas analyzer 240 may, for example, be a tunable diode laser spectrometer (TLDS). The outlet gas analyzer 240 can be configured to scan across the pathway of flue gas exiting the industrial gas appliance 100 and detect for the lower explosive limit concentration of fuel gas anywhere along the scanned pathway. The outlet gas analyzer 240 may be communicatively coupled with the BMS controller 300. If at any time the outlet gas analyzer 240 detects that the concentration of fuel gas approaches or exceeds the lower explosive limit, the system can be safety shut down. In this instance, the safety shut-off valves 220*a-b* for each fuel gas branch 120*a* may be closed to shut off any further fuel gas from being provided to the burners. An operation may be performed to remove fuel gas from the entire industrial gas appliance to restore safe concentration levels. Low oxygen levels and high combustible levels could also be used as alarm inputs to the BMS controller 300. Accordingly, the outlet gas analyzer can provide an enhanced level of safety for operating the industrial gas appliance 100.

A manual shutdown function may also be provided (not shown) that activates a combustion safety interlock. Activation of the manual shutdown may require a manual action from an operator via a button located in the control room or on a control system interface within the industrial gas appliance area or structure.

The system depicted in FIG. 2 may further comprise a purging system (not shown) that may respectively connect with the fuel gas branch 120*a* and/or fuel gas inlet piping 202*a-e* for each burner. The purging system may use nitrogen gas, for example, to purge the fuel lines to ensure that there is no fuel gas remaining in the system prior to performing the start-up/warm-up operation.

While the BMS controller 300 is shown in FIG. 2 as only interacting with a group of the burners, such limitation has been made for explanatory purposes only and it is envisioned that the BMS controller 300 can be configured to control the safe operation of all of the plurality of burners 102 in the industrial gas appliance 100 (i.e. multiple groups). It is also to be understood that the same instrumentation and piping components as described with reference to the subset of burners in FIG. 2 would be implemented with other groups of burners. Moreover, it is to be understood that the representation of the burner management system for controlling the operation of the group of burners in FIG. 2 may also represent a BMS for controlling operation of all of the plurality of burners (i.e. there is only one group of burners that comprises all of the plurality of burners in the industrial gas appliance).

While several examples of instrumentation and piping components have been described above with respect to the combustion gas branch 110*a*, the fuel gas branch 120*a*, and the fuel gas inlet piping 202*a-e* as shown in FIG. 2, a person skilled in the art will readily appreciate that such description of the instrumentation and piping components is non-limiting and that additional and/or alternative components may be used without departing from the scope of this disclosure. The foregoing description of the instrumentation and piping components was made with reference to a simplified representation of the burner management system and, for the sake of clarity, has omitted the description of other components and equipment as would be appreciated by one skilled in the art.

Figure 3:
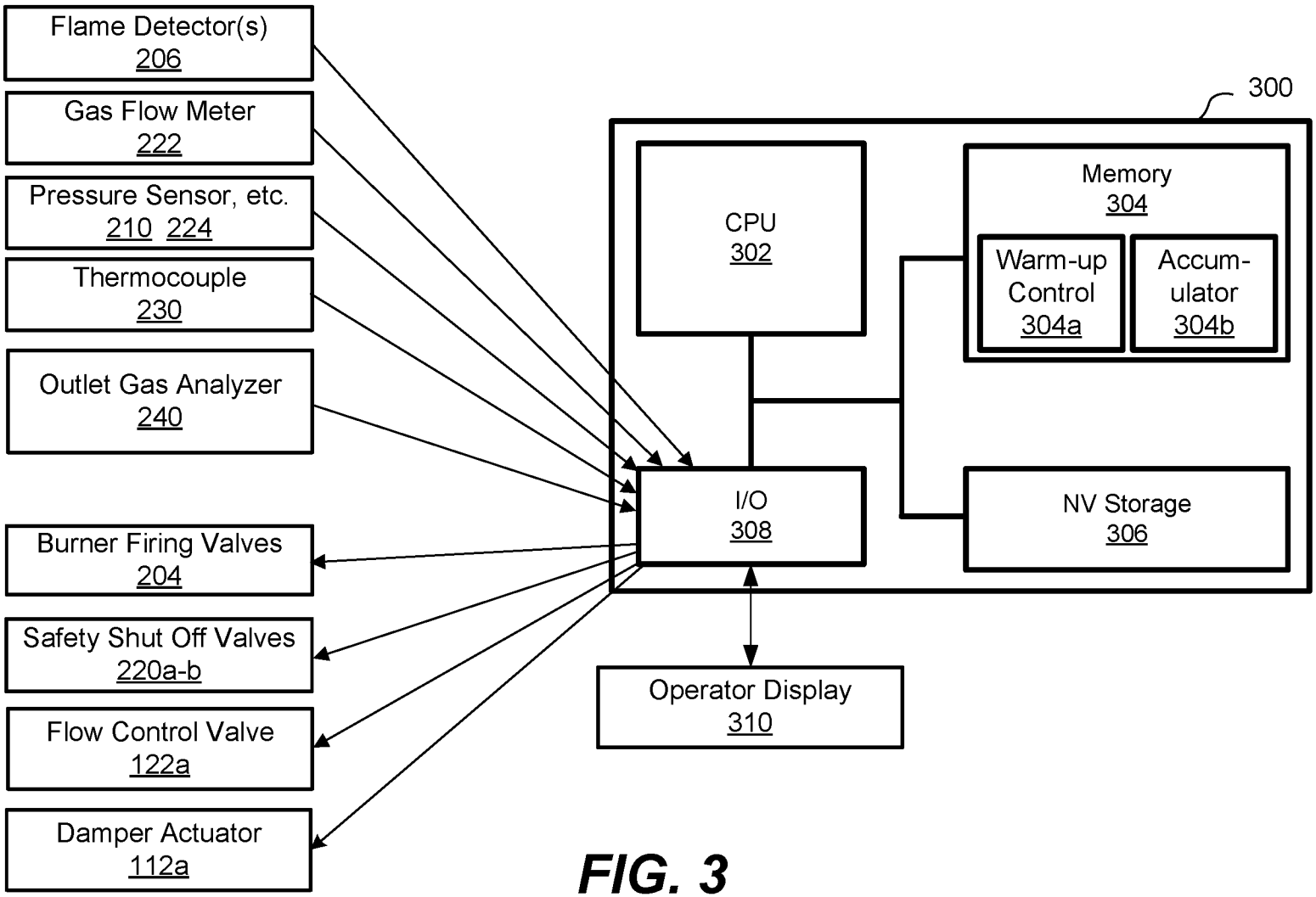
FIG. 3 shows a schematic view of a BMS controller.

FIG. 3 shows a schematic view of a BMS controller 300. The BMS controller 300 may be implemented as a standalone hardware device or distributed across multiple hardware devices, and may comprise, among other things, a processor or CPU 302, a memory 304, a non-volatile storage 306, and an input/output interface 308.

The memory 304 may comprise non-transitory computer-executable instructions that are executable by the processor and configure the processor to perform certain functionality. The non-transitory computer-executable instructions stored on the memory 304 may be configured by a plant operator, for example, in accordance with the configuration of the plant and any pre-defined standard operating procedures. The memory 304 may comprise as a component thereof non-transitory computer-executable instructions 304*a* for performing warm-up control of an industrial gas appliance. The instructions 304*a* for performing warm-up control of the industrial gas appliance may configure the CPU 302 to perform functionality in accordance with the methods defined in FIGS. 4A-4C and FIG. 5.

The memory may further comprise instructions 304*b* providing lower explosive limit (LEL) accumulator functionality. The LEL accumulator functionality provided by the instructions 304*b* may be used in conjunction with the instructions 304*a* for performing warm-up control of the industrial gas appliance. The LEL accumulator functionality may be used to track the number of non-supervised burners with fuel gas flowing thereto, and thus allows the CPU 302 to determine a non-supervised burner status as either corresponding to a safe lighting condition or an unsafe lighting condition. Each time a burner firing valve is opened, the fuel gas flow increases and the LEL accumulator adds "+1" to a count of burners with fuel gas flowing thereto. However, if a supervised burner is lit and the flame detector detects the presence of a flame, this indicates that the fuel gas flowing to the supervised burner is combusting and effectively nulls the flow value, so the LEL accumulator remains at "0". As previously described, if a non-supervised burner is lit there is no way of proving that the fuel gas is being combusted so the LEL accumulator adds "+1". When it is pre-determined that fuel gas flowing to "x" non-supervised burners would result in a concentration of fuel gas that is just below the LEL if none of the fuel gas is combusted, the CPU 302 may determine that the non-supervised burner status is an unsafe lighting condition when the accumulator reaches a value of "x", and the lighting of additional non-supervised burners may be restricted.

The I/O interface 308 may provide a physical interface for communicating and exchanging data with various instrumentation and piping components within the burner management system of the industrial gas appliance, such as those described with reference to FIG. 2. The I/O interface 308 may comprise both ports for providing a physical connection, and may additionally or alternatively comprise communication interfaces for providing a wireless connection with various components in the BMS.

For example, the I/O interface 308 may receive inputs from flame detector(s) 206, the gas flow meter 222, pressure sensors or other instrumentation represented as elements 210 and 224, the thermocouple 230, and the outlet gas analyzer 240. These inputs may be sent through the I/O interface 308 and received at the CPU 302, which may in turn access the memory 304 and/or non-volatile storage 306 to process and/or store the data. The I/O interface 308 may also, for example, be used to send outputs/commands to the burner firing valves 204, the safety shut-off valves 220*a-b*, the flow control valve 122*a*, and the damper actuator 112*a*. The outputs/commands may be generated by the CPU 302 based on instructions stored in its memory 304, for example, and transmitted to these components via the I/O interface 308. The I/O interface 308 may also interface with an operator display 310 for displaying outputs/commands at the display and receiving inputs from the display, for example inputted by an operator. The inputs and outputs that the CPU 302 sends/receives through the I/O interface 308 is not limited to those which are depicted in FIG. 3. The direction of the arrows in FIG. 3 showing inputs and outputs between the BMS controller 300 and the various components may also be reversed, and the BMS controller 300 may be in communication with fewer or more instruments depending on the configuration of the industrial gas appliance and burner management system.

Figure 4A:
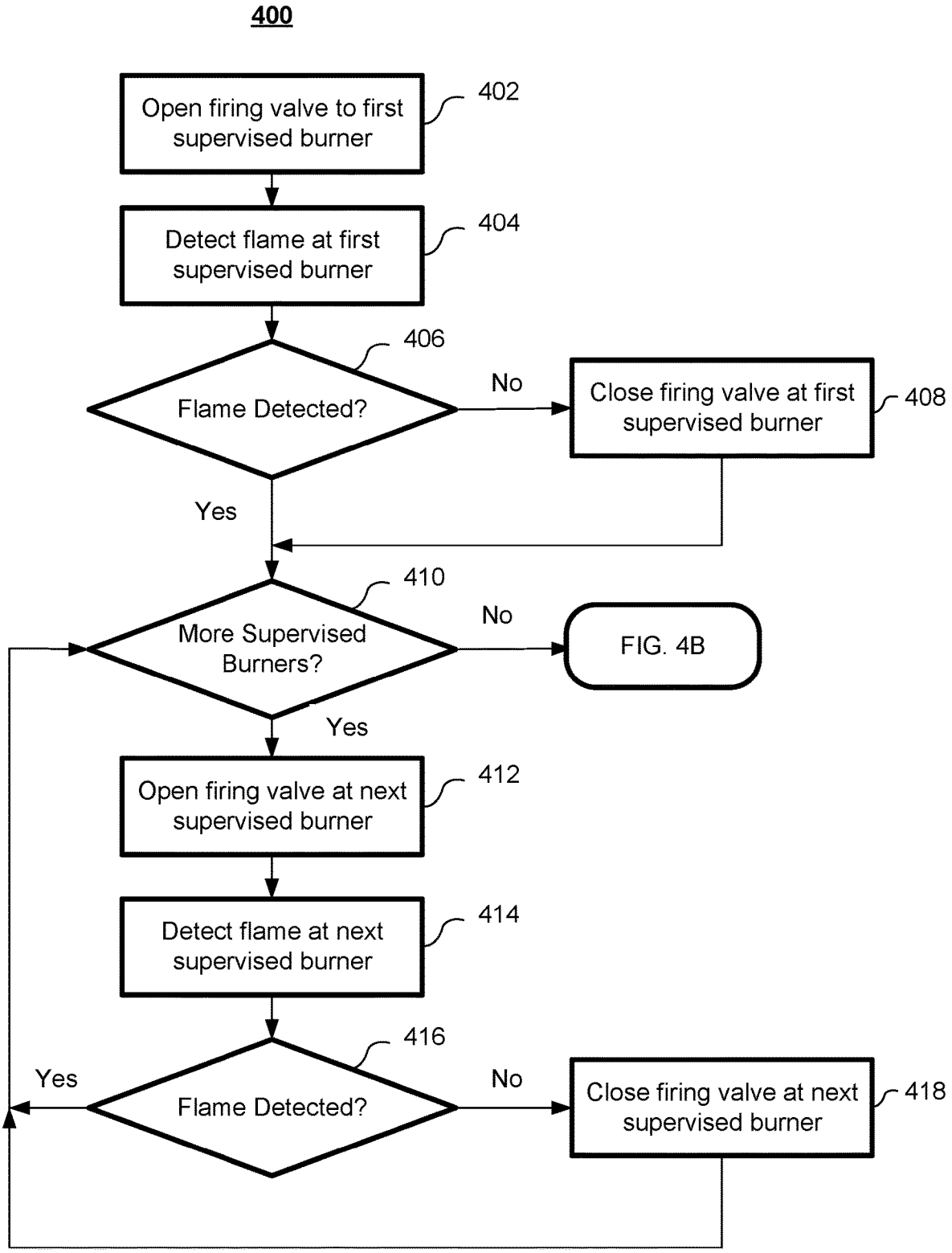
FIGS. 4A-4C show a method for controlling a warm-up operation of an industrial gas appliance comprising a plurality of burners.
Figure 4B:
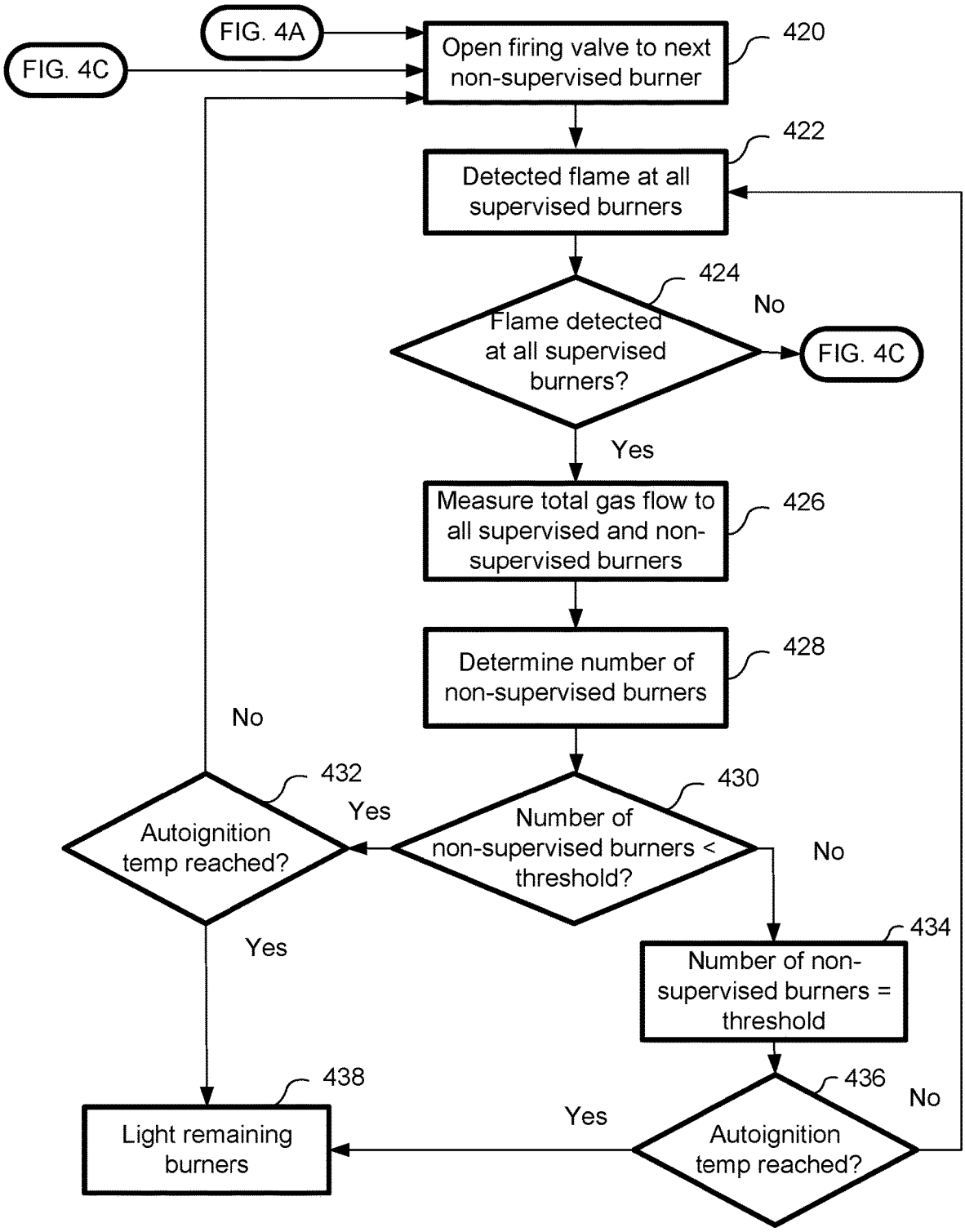
Figure 4C:
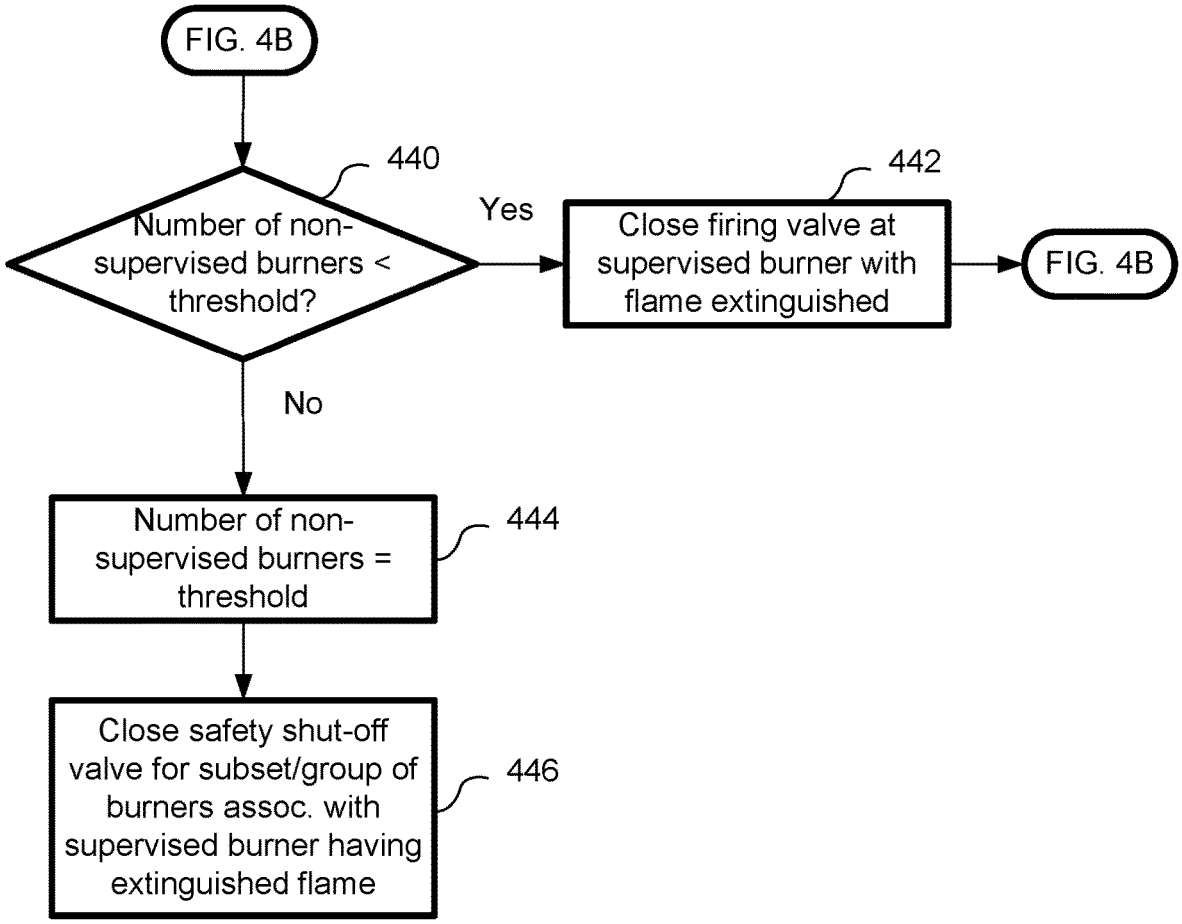

FIGS. 4A-4C show a method 400 for controlling a warm-up operation of an industrial gas appliance comprising a plurality of burners. The method 400 may, for example, be performed by the BMS controller 300 when the CPU 302 executes non-transitory computer-readable instructions stored within the memory 304.

Broadly, the method steps shown in FIG. 4A are directed to the lighting of supervised burners, the method steps shown in FIG. 4B are directed to the incremental lighting of non-supervised burners, and the method steps shown in FIG. 4C are directed to safety controls if a flame at a previously lit supervised burner extinguishes. The method 400 may be used to control the warm-up operation of a group of burners among a plurality of burners within an industrial gas appliance, and/or may be used to control the warm-up operation for all of the plurality of burners whether they are segregated into groups or are treated as a single group.

Prior to lighting of any burners or performing the method 400, the burner management system may be purged, the fuel gas header may be charged, and the safety-shut off valves opened (not shown in FIGS. 4A-4C). These steps may also be performed again if an industrial gas appliance is being restarted after an emergency shut-down. The control that is performed prior to lighting burners may vary depending on plant procedures, but in general, purging is used to ensure removal of flammable gases in the system prior to performing the warm-up operation. The purge may be performed using nitrogen gas, for example. Fuel isolation valves and burner isolation valves may also be tested to ensure that there are no leaks, and such testing may include a pressurization of the fuel piping systems where the pressure is maintained for an adequate period to confirm the seal.

An operator lights a first supervised burner which includes opening a firing valve (402), thus providing the fuel gas thereto. The supervised burner is a burner that has a flame detector installed thereon. An attempt to detect the flame at the first supervised burner is performed (404), and a determination is made as to whether or not a flame is detected at the supervised burner that has just been lit (406). If a flame is detected at the burner (YES at 406), a determination is made as to whether there are more supervised burners that may be lit (410). If the flame is not detected at the burner (NO at 406), the firing valve to the first supervised burner is closed (408), and a determination is made as to whether there are more supervised burners that may be lit (410). In addition to closing the firing valve at the first supervised burner when a flame is not detected, an operator or instrumentation may be used to diagnose why the burner did not light properly. Such diagnosis may be performed prior to lighting any additional burners.

If there are no more supervised burners available to be lit (NO at 410), the method proceeds to step 420 in FIG. 4B. If there are more supervised burners available to be lit (YES at 410), the next supervised burner is lit by opening the firing valve associated with the respective burner (412). As previously described with reference to FIG. 1, the 'next' supervised burner may be defined so as to provide even heating of the industrial gas appliance. An attempt to detect a flame at said next supervised burner is made (414), and a determination is made as to whether or not a flame is detected at the supervised burner that has just been lit (416). If a flame is detected at the burner (YES at 416), a determination is made as to whether there are more supervised burners that may be lit (410). If the flame is not detected at the burner (NO at 416), the firing valve to the burner is closed (418), and a diagnosis as to why the burner did not light or went out may be made.

For the sake of clarity in representing the method flows, FIG. 4A depicts that the control of the warm-up operation only proceeds to FIG. 4B once there are no more supervised burners to be lit. However, as previously described, non-supervised burners may be lit without having lit all of the supervised burners. Non-supervised burners may also be lit prior to lighting of a supervised burner. Accordingly, it should be understood that method 400 and the determination at step 410 of whether there are more supervised burners that may be lit may be modified in accordance with various predefined procedures.

It is also noted that the method flow represented in FIG. 4A assumes that the industrial gas appliance temperature will not reach an auto-ignition temperature of the fuel gas prior to the lighting of supervised burners. However, in implementation a determination of the industrial gas appliance temperature may be continuously made (for example, the BMS controller 300 may continuously or at given intervals receive a temperature measurement reading from thermocouple 230), and if at any point the industrial gas appliance temperature reaches the auto-ignition temperature of the fuel gas the warm-up operation control may be bypassed and all of the burners may be lit.

As depicted in FIG. 4B, a next non-supervised burner may be lit by opening a firing valve to the respective non-supervised burner (420). Similar to the supervised burners, the next non-supervised burner may be defined so as to provide even heating of the industrial gas appliance. An attempt to detect a flame at all supervised burners that have been lit is made (422), and a determination is made as to whether or not a flame is detected at all of the supervised burner that have been lit (424). Performing this determination/verification is useful to ensure that none of the flames at supervised burners which were previously lit have been extinguished. The detection of the flame can be used to indicate a supervised burner status. If a flame is not detected at all of the supervised burners that have previously been lit (NO at 424), the method proceeds to FIG. 4C.

If the flame is detected at all of the supervised burners that have previously been lit (YES at 424), this means that all of the supervised burners remain operational and are combusting fuel gas being provided thereto. A total gas flow to all of the burners (both supervised and non-supervised) is measured (426). A number of non-supervised burners for which fuel gas flow is provided thereto is determined (428) based on the total fuel gas flow to the plurality of burners and the supervised burner status indicating the detection of the flame at supervised burners. Specifically, the number of non-supervised burners with the fuel gas flow thereto is determined by subtracting from the total fuel gas flow a combusted amount of fuel gas flow attributed to the supervised burners that have been lit and for which a flame has been detected. The resulting amount of fuel gas flow for which it cannot be verified as being combusted corresponds to the number of non-supervised burners with fuel gas flow thereto.

A determination is made as to whether the number of non-supervised burners with the fuel gas flow thereto is less than a predetermined threshold number of burners (430). The predetermined threshold number of burners may be a number of burners for which an un-combusted amount of fuel gas flow provided thereto corresponds to a concentration of fuel gas that is below (e.g. just below) a lower explosive limit of the fuel gas. As previously described, when performing the warm-up operation of the industrial gas appliance it is desirable that the maximum amount of un-combusted fuel gas that may exist within the industrial gas appliance system is maintained below an amount of fuel gas corresponding to a concentration that is equal to the lower explosive limit.

If the number of non-supervised burners with fuel gas flow thereto is less than the predetermined threshold number of burners (YES at 430), this corresponds to a non-supervised burner status of a safe lighting condition indicating that a next non-supervised burner can be lit. A determination is made if the industrial gas appliance temperature has reached the auto-ignition temperature of the fuel gas (432). If the industrial gas appliance temperature has not reached the auto-ignition temperature (NO at 432), the method returns to step 420 with incrementally lighting of the next non-supervised burner (420). For the sake of explanation and representation of this method flow, it is assumed that if the auto-ignition temperature has not been reached (NO at 432), then there are more non-supervised burners that may be lit. Furthermore, as has been previously described the method may proceed with lighting a supervised burner (returning to step 410 in FIG. 4A, for example) after a non-supervised burner has been lit, depending on the standard operating procedure of the plant. If the auto-ignition temperature has been reached (YES at 432), then all remaining burners may be lit (438).

If the number of non-supervised burners with fuel gas flow thereto is not less than the predetermined threshold number of burners (NO at 430), then the number of non-supervised burners with fuel gas flow thereto is equal to the predetermined threshold number of burners (434). This corresponds to a non-supervised burner status of an unsafe lighting condition indicating that lighting of additional non-supervised burners should not be performed. It is assumed that the number of non-supervised burners with fuel gas flow thereto can never be more than the predetermined threshold number of burners, particularly because when the non-supervised burners with fuel gas flow thereto is equal to the predetermined threshold number of burners, a determination is made if the industrial gas appliance temperature has reached the auto-ignition temperature of the fuel gas (436) and if the industrial gas appliance temperature has not reached the auto-ignition temperature (NO at 436), the method returns to flame detection at 422. That is, when the non-supervised burners with fuel gas flow thereto is equal to the predetermined threshold number of burners and the industrial gas appliance temperature has not reached the auto-ignition temperature of the fuel gas, then the lighting of a next non-supervised burner is not performed, and the controller would restrict/prevent an operator from lighting another non-supervised burner. If the auto-ignition temperature has been reached (YES at 436), then all remaining burners may be lit (438).

As previously described, the method flow 400 proceeds to FIG. 4C when it has been determined that a flame is not detected at all of the supervised burners that have previously been lit (NO at 424). That is, a flame that was previously detected at a lit supervised burner is now extinguished. This is a problem because fuel gas flow is being provided to the supervised burner, and it is confirmed that the fuel gas is not being combusted. Accordingly, the amount of fuel gas accumulating in the system is increasing.

A determination is made if the number of non-supervised burners with fuel gas flow thereto is below the predetermined threshold number of burners (440). If the number of non-supervised burners with fuel gas flow thereto is below the predetermined threshold number of burners (YES at 440), then the firing valve to the supervised burner with the flame that has been extinguished is closed (442) so as to prevent further flow of fuel gas to the burner. The method may then return to step 420 in FIG. 4B. If the number of non-supervised burners with fuel gas flow thereto is not below the predetermined threshold number of burners (NO at 440), then the number of non-supervised burner with fuel gas flow thereto is equal to the predetermined threshold number of burners (444). In this case, the safety shut-off valve associated with a subset or group of burners that are associated with the supervised burner with the flame that has been extinguished is closed (446).

The reasoning for the above control depending on whether the number of non-supervised burners with fuel gas flow thereto is below the predetermined threshold number of burners, i.e., whether the non-supervised burner status corresponds to a safe or unsafe lighting condition, is as follows. As previously described, the predetermined threshold number of burners may be a number of burners for which an un-combusted amount of fuel gas flowing thereto corresponds to a concentration of fuel gas that is just below a lower explosive limit of the fuel gas. Accordingly, if the number of non-supervised burners with fuel gas flowing thereto is less than the predetermined threshold number (YES at 440), and a flame of a previously lit supervised burner is extinguished and fuel gas continues to be provided to said supervised burner, then the maximum amount of un-combusted fuel gas that might be present in the system would correspond to fuel gas being provided to the number of non-supervised burners plus the supervised burner with the flame that has been extinguished, which would at most correspond to the predetermined threshold number of burners, and is still a safe operating condition. Accordingly, the firing valve at the supervised burner with the flame extinguished is closed (442). Depending on plant procedure, a shut-off valve for a subset of burners associated with the supervised burner having its flame extinguished may be closed in addition to, or instead of, closing the firing valve for the supervised burner.

If the number of non-supervised burners with fuel gas flow thereto is not less than the predetermined threshold number (NO at 440), and a flame of a previously lit supervised burner is extinguished and fuel gas continues to be provided to said supervised burner, then the maximum amount of un-combusted fuel gas that might be present in the system would correspond to fuel gas being provided to the number of non-supervised burners plus the supervised burner with the flame that has been extinguished, which would correspond to a number of burners greater than the predetermined threshold number of burners and is not a safe operating condition. Accordingly, the safety shut-off valve is closed to stop the flow of fuel gas to a subset or group of the burners associated with the supervised burner having the extinguished flame (446). An operator may investigate the cause of the supervised burner malfunction. After a predetermined time has elapsed and safety procedures have been performed for the concentration of fuel gas to return below the concentration corresponding to the lower explosive limit, the warm-up operation may resume by returning to the steps in FIG. 4A and/or FIG. 4B.

It may be advantageous to limit the amount of heating upset to the industrial gas appliance as much as possible. The warm-up cycle for the industrial gas appliance is time dependent and important to production, so the faster that the industrial gas appliance temperature can be increased while still ensuring proper safety is better. Accordingly, when the industrial gas appliance is still in a safe operating condition only the firing valve to the supervised burner with the flame extinguished is closed (442). When the industrial gas appliance enters into an unsafe operating condition such as when the number of non-supervised burners with fuel gas thereto being equal to the predetermined threshold number of burners, plus fuel gas is being provided to a supervised burner and is not combusting, then a safety shut-off valve for a subset or group of the burners is closed (446), rather than tripping the entire industrial gas appliance.

The foregoing description assumes that only one supervised burner that has been previously lit may be found to have its flamed extinguished at a given time. However, in the case that at a single time instant it is determined that multiple supervised burners have become nonoperational, the same method applies except that the determination (440) would be adjusted. For example, if two supervised burners that have been previously lit are found at the same time to have their flame extinguished, than the determination (440) may be as to whether the number of non-supervised burners with fuel gas flow thereto is two burners less than the predetermined number of threshold burners.

As previously described, the control method 400 may be implemented for a group of burners, or may apply to all of the plurality of burners in the industrial gas appliance, whether segregated into groups of burners or treated as a single group.

For example, where the method applies to all burners treated as a single group, or a group of burners among a plurality of burners, determinations such as whether there are more supervised burners (410), if the flame is detected at all supervised burners (424), and if the non-supervised burners with fuel gas thereto is less than a predetermined threshold number of burners (430, 440), would apply to the group of burners (or all of the burners if the plurality of burners is treated as a single group). The safety shut-off valve may be closed (446) to stop fuel gas flow to the group of burners (e.g. a row of burners) if the control is separated for respective groups of burners. If the control is implemented for all of the burners in the industrial gas appliance and all of the burners are treated as a single group, then the safety shut-off valve may be closed to stop fuel gas flow to a subset of burners associated with the nonoperational supervised burner, such as a row or column of burners containing said supervised burner, or to the supervised burner and the burners nearest to it, etc., as may depend on the industrial gas appliance layout and piping and instrumentation configuration.

Where the method applies to all burners among a plurality of burners in the industrial gas appliance, and the plurality of burners are segregated into groups (for example, rows of burners, etc.), the control method performs some steps that are related to the plurality of burners, and some steps that are related only to a particular group of burners.

For example, in FIG. 4A a first supervised burner may be lit (402) that belongs in a first group of burners. The determination (410) of whether or not there are more supervised burners available to be lit may not be limited to only the group of burners comprising the first supervised burner. Lighting of the next supervised burner (412) may for example correspond to a supervised burner in a different group of burners. The lighting of the next supervised burner that belongs to a different group of burners than the group comprising the first supervised burner may be performed based on standard operating procedures of the plant and/or to ensure even heating of the industrial gas appliance, as described with reference to FIG. 1.

In FIG. 4B, lighting a next non-supervised burner (420) may similarly be in respect of non-supervised burners belonging to different groups of burners. However, detecting the flame at all supervised burners (422), and the determination as to whether the number of non-supervised burners with fuel gas flow thereto (430), may be specific to a particular group of burners. As described with reference to FIG. 2, a gas flow meter and safety shut-off valve(s) may be provided for respective groups of burners, and for each group of burners it is desirable for the number of non-supervised burners with fuel gas flow thereto in that group to be less than or equal to a predetermined threshold number of burners for the group.

Despite the above determinations being made with respect to only a particular group of burners, it is noted that the detection of the flame at all supervised burners may be performed continuously for all groups of burners. As previously described with reference to FIG. 4C, this is because the determination that a flame at a previously lit supervised burner is extinguished may lead to unsafe operating conditions.

Furthermore, the lighting of all remaining unlit burners (438) may relate to all of the burners in the industrial gas appliance, because the temperature of the industrial gas appliance has reached the auto-ignition temperature of the fuel gas.

As evident from the above, the method for controlling a warm-up operation of the industrial gas appliance as described with reference to FIGS. 4A-4C is a representation of the method and is made for explanatory purposes only. A person skilled in the art will readily appreciate that modifications of this control method can be made without departing from the scope of this disclosure.

Figure 5:
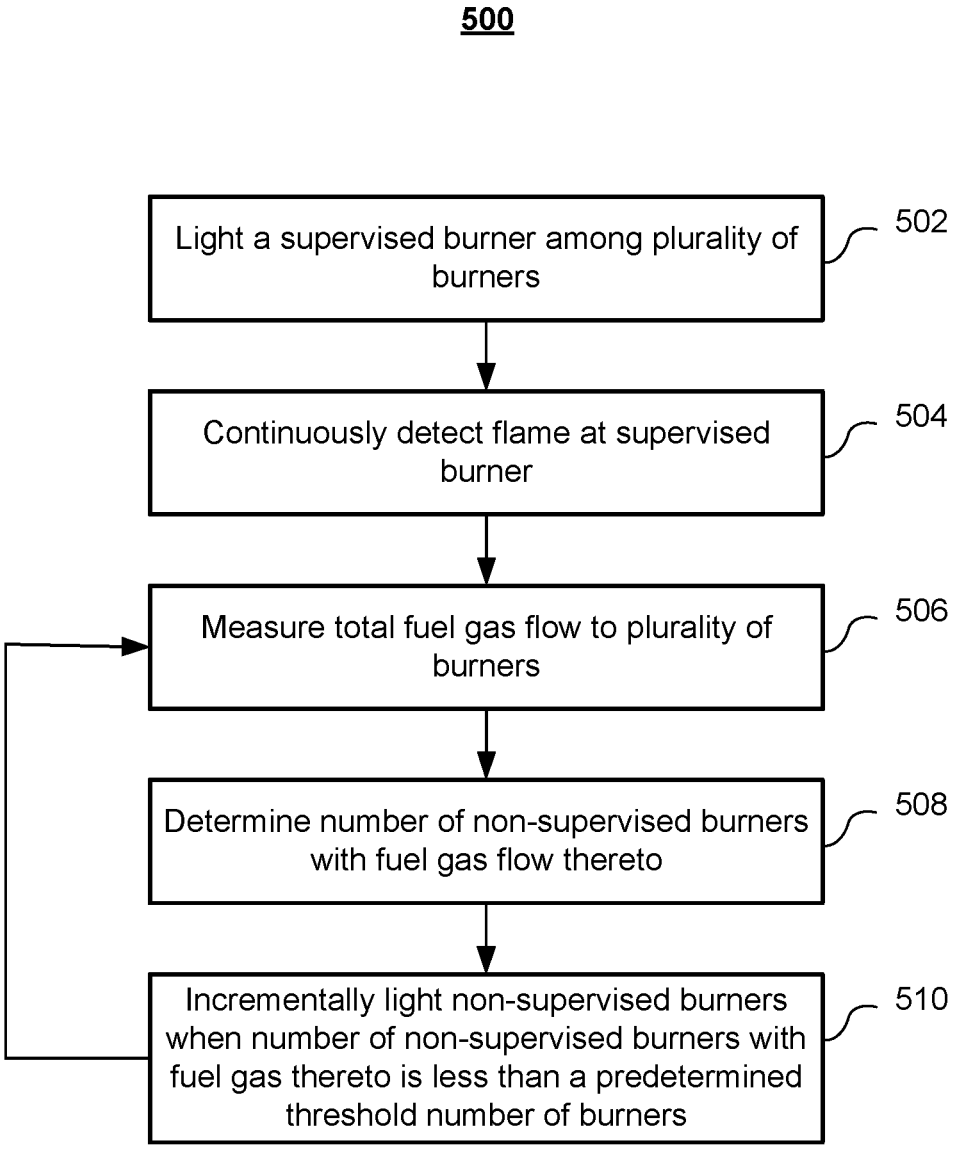
FIG. 5 shows an overall method for controlling the warm-up operation of the industrial gas appliance comprising the plurality of burners.

FIG. 5 shows an overall method 500 for controlling the warm-up operation of the industrial gas appliance comprising the plurality of burners. The method 500 may, for example, be performed by the BMS controller 300 when the CPU 302 executes non-transitory computer-readable instructions stored within the memory 304.

The method 500 comprises lighting a supervised burner among a plurality of burners in the industrial gas appliance by providing a fuel gas flow thereto (502). The method further comprises continuously detecting a flame at the supervised burner indicating that the supervised burner is lit (504). A total fuel gas flow to the plurality of burners is measured (506). A number of non-supervised burners with fuel gas flow thereto is determined based on the total fuel gas flow to the plurality of burners and a supervised burner status indicating the detection of the flame at the supervised burner (508). Non-supervised burners among the plurality of burners are incrementally lit by providing the fuel gas flow thereto when the non-supervised burner status indicates a safe lighting condition and the number of non-supervised burners with the fuel gas flow thereto is less than a predetermined threshold number of burners (510). When incrementally lighting non-supervised burners, after every non-supervised burner has been lit the non-supervised burner status is determined by measuring the gas flow (506) and determining the number of non-supervised burners with fuel gas flowing thereto (508).

As previously described, the number of non-supervised burners with the fuel gas flow thereto may be determined by subtracting a combusted amount of fuel gas flow attributed to the supervised burner that has been lit and for which the flame has been detected, from the total gas flow.

As previously described, when the number of non-supervised burners with the fuel gas flow thereto is equal to the predetermined threshold number of burners, the non-supervised burner status corresponds to an unsafe lighting condition and the incremental lighting of a next non-supervised burner may be restricted.

As previously described, the predetermined threshold number may be a number of burners for which an un-combusted amount of fuel gas flow provided thereto corresponds to a concentration of fuel gas that is equal to a lower explosive limit of the fuel gas.

The method 500 may be performed continuously during a warm-up operation of the industrial gas appliance until a temperature of the industrial gas appliance reaches an auto-ignition temperature of the fuel gas. The method 500 may advantageously provide for safely controlling a warm-up operation of the industrial gas appliance using a lower explosive limit based burner management system control, and without requiring a flame detector to be installed at every burner in the industrial gas appliance. The method 500 may be implemented for a group of burners among a plurality of burners in the industrial gas appliance, and/or for all burners in the industrial gas appliance whether segregated into multiple groups of burners or treated as a single group of burners.

These and other features and advantages of the present disclosure will be readily apparent from the detailed description, the scope of the invention being set out in the appended claims.

The present disclosure is set forth in various levels of detail in this application and no limitation as to the scope of the claimed subject matter is intended by either the inclusion or non-inclusion of elements, components, or the like in the summary. In certain instances, details that are not necessary for an understanding of the disclosure or that render other details difficult to perceive may have been omitted. It should be understood that the claimed subject matter is not necessarily limited to the particular embodiments or arrangements illustrated herein.

The accompanying drawings are provided for purposes of illustration only, and the dimensions, positions, order, and relative sizes reflected in the drawings attached hereto may vary. The detailed description will be better understood in conjunction with the accompanying drawings, with reference made in detail to embodiments of the present subject matter, one or more examples of which are illustrated in the drawings. Each example is provided by way of explanation of the present subject matter, not limitation of the present subject matter. In fact, it will be apparent to those skilled in the art that various modifications and variations can be made in the present disclosure without departing from the scope or spirit of the present subject matter. Thus, it is intended that the present subject matter covers such modifications and variations as come within the scope of the appended claims and their equivalents.

The invention claimed is:

1. A burner management system for an industrial gas appliance comprising a plurality of gas burners, the system comprising:

one or more flame detectors each configured to perform flame detection of respective supervised burners among the plurality of burners, the plurality of burners comprising a first group of burners of equal capacity having at least one supervised burner and at least one non-supervised burner;

a gas flow meter for measuring a cumulative fuel gas flow to the first group of burners; and a controller configured to:

continuously receive an indication from the one or more flame detectors whether a flame for each of the at least one supervised burner is detected;

receive the measured cumulative fuel gas flow from the gas flow meter; and determine a non-supervised burner status for the first group of burners based on the number of non-supervised burners with fuel gas flowing thereto, wherein the number of non-supervised burners with fuel gas flowing thereto is determined from the measurement of the cumulative fuel gas flowing to the first group of burners and a supervised burner status indicating the detection of the flame at the respective supervised burners, and wherein when the non-supervised burner status indicates an unsafe lighting condition the controller restricts the opening of a burner firing valve associated with any unlit non-supervised burner in the first group of burners, the unsafe lighting condition occurring when the number of non-supervised burners is equal to or greater than a predetermined threshold number of burners while it is detected that the supervised burner is lit, the predetermined threshold number of burners is a number of burners for which an un-combusted amount of fuel gas flowing thereto corresponds to a concentration of fuel gas that is below a lower explosive limit of the concentration of fuel gas.

2. The burner management system of claim 1, wherein when the supervised burner status indicates that the flame of a supervised burner among the at least one supervised burner in the first group of burners fails to be detected, and when the non-supervised burner status indicates a safe lighting condition when the number of non-supervised burners in the first group of burners with the fuel gas flowing thereto is less than the predetermined threshold number of burners, the controller is configured to output a command for closing a firing valve associated with the supervised burner to stop the fuel gas flowing to the supervised burner for which the flame fails to be detected.

3. The burner management system of claim 1, wherein when the supervised burner status indicates that the flame of a supervised burner among the at least one supervised burner in the first group of burners fails to be detected, and when the non-supervised burner status indicates the unsafe lighting condition, the controller is configured to output a command for closing a safety shut-off valve associated with the first group of burners to stop the fuel gas flowing to the first group of burners.

4. The burner management system of claim 3, wherein the plurality of burners comprises a second group of burners with fuel gas flowing thereto, and the fuel gas continues to flow to the second group of burners after the fuel gas flowing to the first group of burners is stopped.

5. The burner management system of claim 1, further comprising:

a temperature sensor for measuring a temperature of a combustion gas supplied to the plurality of burners, and wherein the controller is further configured to:

receive the temperature of the combustion gas in the industrial gas appliance; and when the temperature of the combustion gas in the industrial gas appliance is equal to or greater than an auto-ignition temperature of the fuel gas, output a command for supplying the fuel gas to all unlit burners among the plurality of burners in the industrial gas appliance.

6. The burner management system of claim 1, further comprising:

an outlet gas analyzer that is configured to measure a concentration of fuel gas leaving the industrial gas appliance; and wherein the controller is configured to:

receive the measured concentration of fuel gas leaving the industrial gas appliance; and when the measured concentration of fuel gas leaving the industrial gas appliance exceeds a predetermined threshold concentration, stop the fuel gas flow to the plurality of burners by closing one or more safety shut-off valves.

7. The burner management system of claim 1, wherein the one or more flame detectors are one of an optical flame detector and a flame rod detector.

8. The burner management system of claim 1, wherein the fuel gas is provided in a fuel gas header with respective fuel gas branches to each group of burners, and wherein each fuel gas branch comprises a respective gas flow meter and at least one safety shut-off valve.

9. The burner management system of claim 1, wherein the opening of the burner firing valve is restricted by: outputting an electrical signal to prevent the burner firing valve from opening, or by outputting an electrical signal to prevent the burner firing valve from opening and outputting an indication to an operator that the non-supervised burner status indicates an unsafe operating condition.

10. A method of controlling a warm-up operation of an industrial gas appliance, the method comprising:

lighting a supervised burner among a plurality of burners of equal capacity in the industrial gas appliance by providing a fuel gas flow thereto;

continuously detecting a flame at the supervised burner indicating that the supervised burner is lit; and incrementally lighting non-supervised burners among the plurality of burners by providing the fuel gas flow thereto when a non-supervised burner status indicates a safe lighting condition, the safe lighting condition occurring when a number of non-supervised burners with the fuel gas flowing thereto is less than a predetermined threshold number of burners while it is detected that the supervised burner is lit, the non-supervised burner status being determined by:

measuring a total fuel gas flowing to the plurality of burners; and determining the number of the non-supervised burners with the fuel gas flowing thereto from the measurement of the total fuel gas flowing to the plurality of burners and a supervised burner status indicating the detection of the flame at the supervised burner;

wherein the predetermined threshold number of burners is a number of burners for which an un-combusted amount of fuel gas flowing thereto corresponds to a concentration of fuel gas that is below a lower explosive limit of the concentration of fuel gas.

11. The method of claim 10, wherein the number of non-supervised burners of equal capacity with the fuel gas flowing thereto is determined by subtracting a combusted amount of fuel gas flow attributed to the supervised burner that has been lit and for which the flame has been detected, from the total gas flow.

12. The method of claim 10, wherein when the number of non-supervised burners with the fuel gas flowing thereto is equal to the predetermined threshold number of burners, the non-supervised burner status corresponds to an unsafe lighting condition and incremental lighting of a next non-supervised burner is restricted.

13. The method of claim 10, wherein when the supervised burner status indicates that the flame of the supervised burner fails to be detected, and when the non-supervised burner status indicates a safe lighting condition, the fuel gas flowing to the supervised burner is stopped.

14. The method of claim 10, wherein when the supervised burner status indicates that the flame of the supervised burner fails to be detected, and when the non-supervised burner status indicates an unsafe lighting condition, the fuel gas flowing to the non-supervised burners and the supervised burner is stopped.

15. The method of claim 10, further comprising:

determining a temperature of combustion products in the industrial gas appliance; and when the temperature of the combustion products in the industrial gas appliance is equal to or greater than an auto-ignition temperature of the fuel gas, supplying the fuel gas to all unlit burners among the plurality of burners.

16. The method of claim 10, further comprising:

continuously detecting a respective flame at each of the supervised burners indicating that the respective supervised burner is lit, the supervised burner status indicating the detection of flames at the respective supervised burners that have been lit; and lighting one or more additional supervised burners among the plurality of burners in the industrial gas appliance by providing the fuel gas flow thereto upon determining the supervised burner status.

17. The method of claim 10, wherein the flame for the supervised burner is detected using a flame detector associated with the supervised burner.

18. The method of claim 10, wherein the lighting of the supervised burner and the incremental lighting of the non-supervised burners is staggered among the plurality of burners to provide even heating of the industrial gas appliance.

* * * * *